United States Patent [19]

Copie et al.

[11] 4,427,334

[45] Jan. 24, 1984

[54] LOAD HANDLING APPARATUS

[75] Inventors: Fernand Copie, Minneapolis; Warren E. Esterberg, Plymouth, both of Minn.; Quentin K. Fadness, Boring; Howard A. Stewart, Portland, both of Oreg.; Robert J. Ringwelski, Maple Grove, Minn.

[73] Assignee: RayGo, Inc., Minneapolis, Minn.

[21] Appl. No.: 349,182

[22] Filed: Feb. 17, 1982

[51] Int. Cl.[3] ..... E02F 3/70

[52] U.S. Cl. ..... 414/710; 414/685; 414/706; 414/917

[58] Field of Search ..... 248/280.1, 325; 414/917, 685, 697, 706, 707, 710, 712, 714, 728

[56] References Cited

U.S. PATENT DOCUMENTS

| | | | |
|---|---|---|---|
| 2,724,620 | 11/1955 | Johnson et al. | 304/29 |
| 2,787,391 | 4/1957 | Matheson | 214/140 |
| 2,803,359 | 8/1957 | Pokorny | 214/140 |
| 2,887,236 | 5/1959 | Mindrum | 214/140 |
| 2,959,305 | 11/1960 | Konefes | 214/140 |
| 2,980,271 | 4/1961 | Ulinski | 214/140 |
| 3,001,654 | 9/1961 | Albert | 214/140 |
| 3,070,244 | 12/1962 | Lull | 214/140 |
| 3,074,572 | 1/1963 | Ulinski | 414/712 X |
| 3,187,911 | 6/1965 | Christenson | 214/140 |
| 3,209,930 | 10/1965 | Derruppe | 214/140 |
| 3,319,739 | 5/1967 | Morse | 182/2 |
| 3,338,443 | 8/1967 | Zimmerman | 214/770 |
| 3,411,647 | 11/1968 | Zimmerman | 414/707 |
| 3,484,004 | 12/1969 | Hughey | 214/130 |
| 3,491,906 | 1/1970 | Davidson | 414/707 |
| 3,606,060 | 9/1971 | Fleming et al. | 214/771 |
| 3,688,929 | 9/1972 | McIntyre | 214/78 |
| 3,695,474 | 10/1972 | Blakely | 214/771 |
| 3,844,435 | 10/1974 | Zimmerman | 214/776 |
| 3,876,101 | 4/1975 | Stedman | 414/917 X |
| 3,913,767 | 10/1975 | Carriere | 414/707 |
| 3,952,890 | 4/1976 | Armstrong | 414/712 X |
| 4,106,646 | 8/1978 | Weisgerber | 214/147 |
| 4,135,632 | 1/1979 | Berkel, Jr. | 214/761 |
| 4,217,076 | 8/1980 | Robnett et al. | 414/735 |

OTHER PUBLICATIONS

Brochure-*RayGo-Wagner Port Packers—Piggy Packers*, RayGo-Wagner, Portland, Oregon.

*Primary Examiner*—James L. Rowland
*Assistant Examiner*—Terrance L. Siemens
*Attorney, Agent, or Firm*—Burd, Bartz & Gutenkauf

[57] ABSTRACT

A load handling and transporting vehicle is provided with a load handling apparatus movable from a compact low profile position to an extended position. The load handling apparatus has a main lift beam pivotally connected to a link and control beam. A second link connects the control beam to the frame. Piston and cylinder assemblies connected to the main lift beam and frame operate to move the main lift beam, links, and control beam from adjacent nested positions to extended positions. A cargo container carrier is mounted on a third link pivotally connected to the forward ends of the main lift beam and control beams.

29 Claims, 8 Drawing Figures

Fig.3
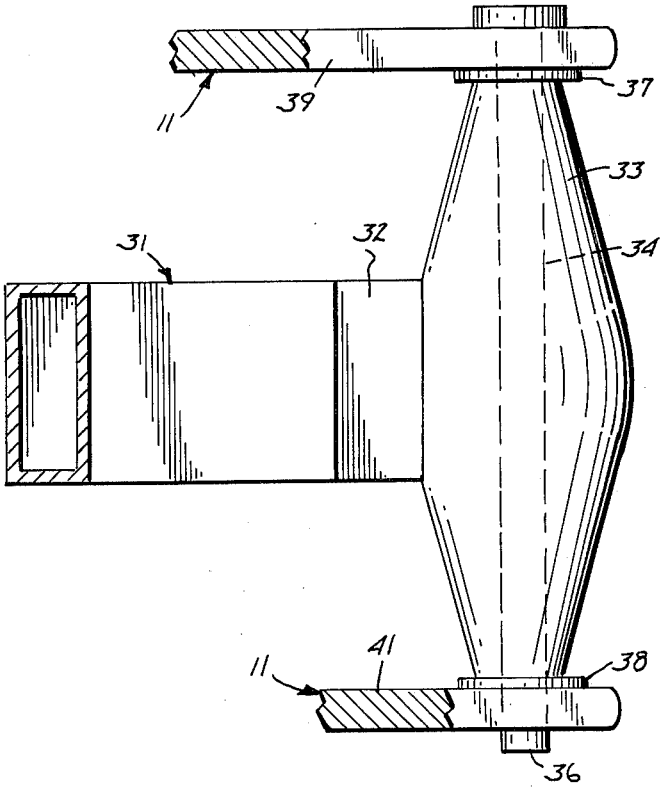
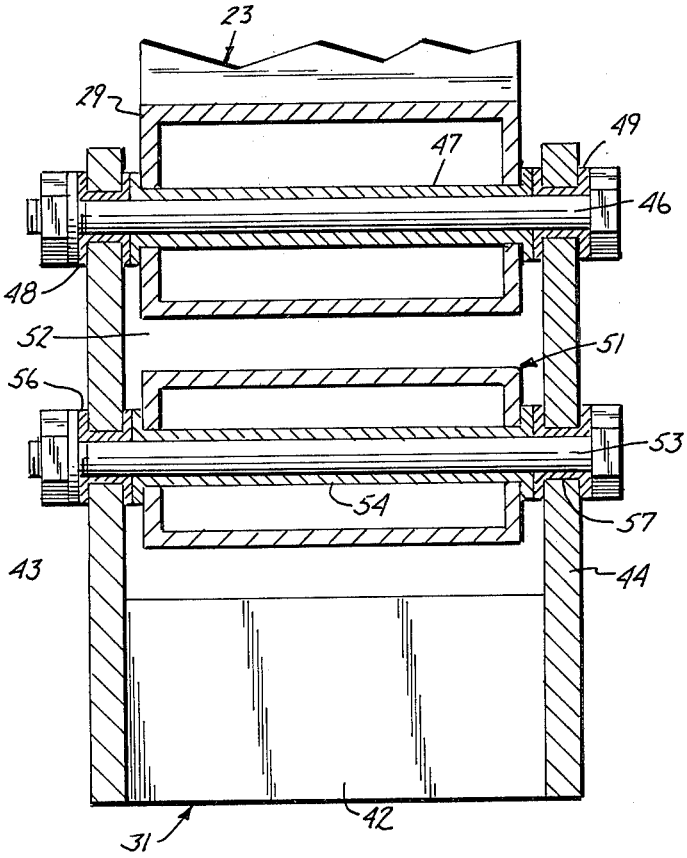
Fig.4

LOAD HANDLING APPARATUS

FIELD OF INVENTION

The present invention relates to a material handling apparatus for handling heavy loads, such as cargo containers, trailers, and bulk cargo. More particularly, the invention is embodied in a load handling and transporting vehicle having a load handling apparatus used to lift and transport heavy loads, such as cargo containers, cargo trailers, and bulk cargo.

SUMMARY OF INVENTION

The invention comprises a load handling apparatus useable with a support to move a load, such as a cargo container, from one location to another location. The apparatus has a main lift beam extended in a generally longitudinal direction. The beam has a forward end and a rear end. A first link means is pivotally connected to the rear end of the main lift beam and the support. A control beam means is located generally parallel and below the main lift beam. A pivot means pivotally interconnects an intermediate portion of the control beam means to the first link means adjacent the upper end thereof. A second link means is pivotally connected to the support and the rear end of the control beam means. A third link means pivotally connected to the forward ends of the lift beam and control beam is connected to a load carrying structure or gallows. The gallows has releasable clamp structures adapted to be secured to a cargo container. Longitudinally extendible and contractible means mounted on the support and pivotally connected to a mid-portion of the lift beam are used to move the lift beam from a retracted position to an extended position and back to a retracted position. This moves the load carrying structure along a linear path. When the lift beam is in the retracted position, it is in a nested or folded position relative to first link means and control beam means whereby the entire load handling apparatus has a low profile.

The extendible and contractible means comprise fluid operated piston and cylinder means operable to pivot the first and second links relative to the support about separate axes and move the load carrying structure along a generally linear path. The load carrying structure remains in the linear path during movement between the extended and retracted positions. The load carrying structure is self-leveling during its vertical movement.

The second link means may be equipped with extendible and contractible means, such as fluid operated piston and cylinder means, operable to vary the length of the second link means. When the length of the second link means is shortened, the load carrying structure is moved to a rear or aft tilt position. This locates the load rearwardly of the normal linear path of movement of the load carrying structure and at a slight upwardly inclined angle. Increasing the length of the second link means moves the load lifting structure to a forward or fore tilt position forwardly of the linear path of movement of the load lifting structure. The load carrying structure is located in a slight downwardly inclined angle.

In one form of the invention, the support is part of the frame of a load handling and transporting vehicle. The vehicle has forward drive wheels connected to the frame and steerable wheels operably mounted on the rear of the frame. A load handling apparatus operably mounted on the frame is used to pick up and stack cargo containers and like loads. The load handling apparatus has lift beam means located above the frame and extended in a longitudinal direction of the frame. The first link means is located below the lift beam means and pivotally connected to the frame and the rear end of the lift beam means. A control beam means is located between the lift beam means and the first link means. The rear end of the control beam means is connected to a second link means. The forward ends of the control beam means and main lift beam means are connected to a third link means that is secured to the cargo supporting structure. The center of gravity of the load handling apparatus is behind the front drive wheels so as to distribute the weight of the apparatus to both the front and rear wheels. The load handling apparatus can be lowered to a nested position adjacent the frame thereby providing the vehicle with good operator visibility. The second link means can include extendible and contractible means, such as hydraulic piston and cylinder assemblies, operable to vary the length of the second link means to effect a tilting or canting of the load carrying structure.

An object of the invention is to provide a vehicle with a movable load handling apparatus that can be retracted to a nested position to provide the vehicle with a relatively low profile for handling objects, such as cargo containers. Another object of the invention is to provide a load handling machine with a relatively low profile so that it can be used as a roll-on and roll-off vehicle for loading and unloading cargo ships. A further object of the invention is to provide a load handling apparatus with a main lift beam, a control beam, and link means that fold relative to each other into a nested arrangement to provide the load handling apparatus with a relatively compact and low profile and yet allow the beams and link means to be extended to a relatively long extended position or reach. A further object of the invention is to provide a load handling apparatus with pivotally interconnected beam structures connected to a load carrier that is operable to self-level the carrier and move the carrier from a contracted position to an extended position along a linear path. Yet another object of the invention is to provide a load handling vehicle with a lift apparatus that is operable to maintain a substantially constant non-shifting load on the wheels of the vehicle during the lift operation. Still another object of the invention is to provide a load handling apparatus with control structure that is operable to permit the rearward tilting of a load carrier during load handling movements of the apparatus. These and other objects and advantages of the invention are set out in the following description of one embodiment of the load handling apparatus.

IN THE DRAWINGS

FIG. 3 is an enlarged sectional view taken along the line 3—3 of FIG. 1;

FIG. 4 is an enlarged sectional view taken along the line 4—4 of FIG. 1;

DESCRIPTION OF PREFERRED EMBODIMENT

Figure 1:
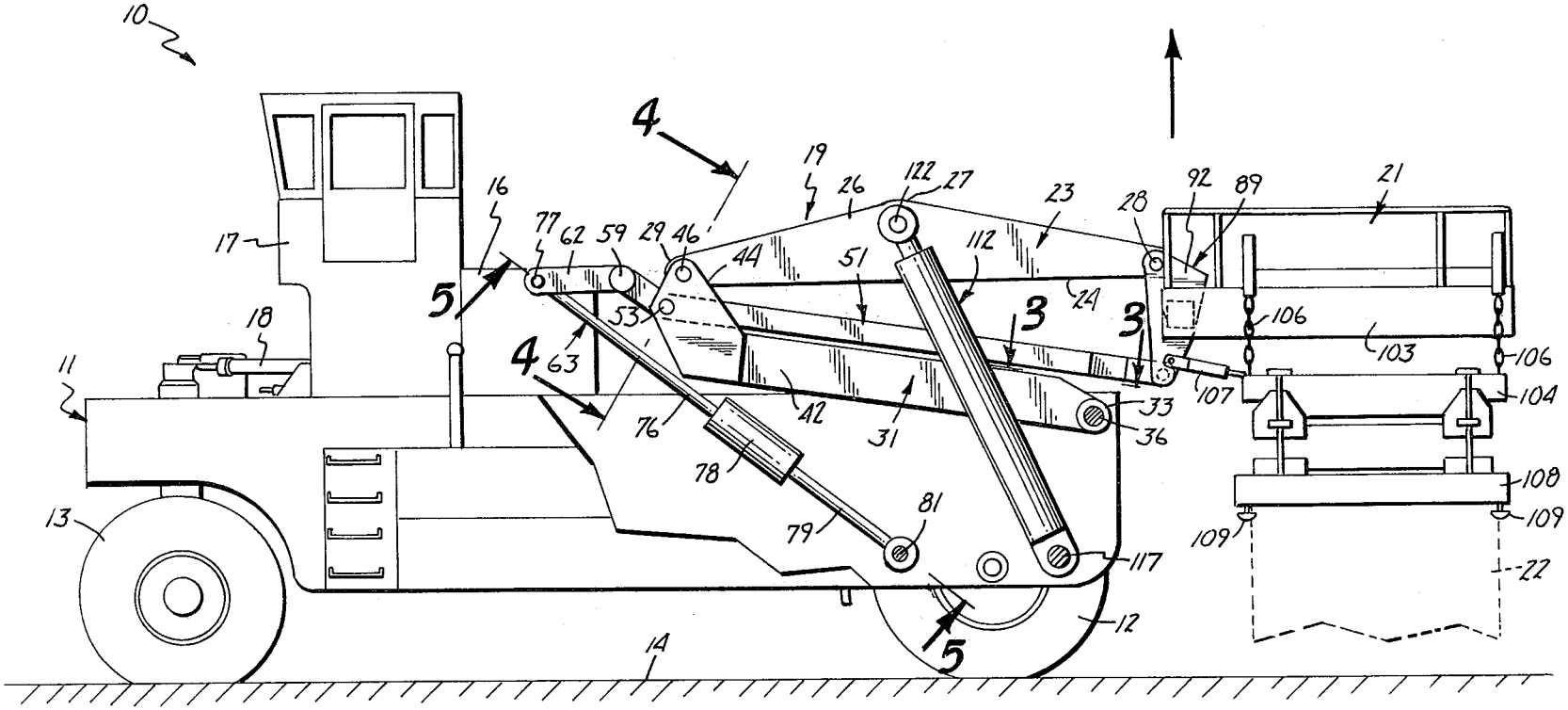
FIG. 1 is a side elevational view of a mobile container handling vehicle with part of the frame broken away to show the load handling apparatus.

Referring to FIG. 1, there is shown a motor driven mobile vehicle indicated generally at 10 having a generally horizontal longitudinal frame 11. A pair of front drive wheels 12 are mounted on the front of frame 11. A pair of rear steering wheels 13 are rotatably mounted on the rear of frame 11. Wheels 12 and 13 rotatably and drivably support vehicle 10 on the ground 14. The vehicle 10 has an internal combustion engine 16 operatively connected to drive wheels 12 with power transmission and differential assemblies (not shown). An operator cab 17 is mounted on the rear portion of frame 11 adjacent a steering control assembly 18 for steering wheels 13.

A load handling apparatus indicated generally at 19 is operably mounted on frame 11 in front of cab 17. Apparatus 19 supports load lift structure or a load carrier 21, known as a gallows, used to handle cargo containers 22. Lift structure 21 can be modified to handle cargo trailers and slingloaded non-containerized cargo. Lift structure 21 can be replaced with forks or a load lifting mechanism disclosed in U.S. Pat. No. 4,016,992. Vehicle 10 is a load handling machine used in ports and terminals to lift and stack cargo containers. The cargo containers are removed from docks and barges and stacked in a storage location in a smooth and efficient manner with vehicle 10. Vehicle 10 is equipped with load handling apparatus 19 and has a relatively low profile, permitting use as a roll-on and roll-off vehicle for loading and unloading cargo ships.

Vehicle frame 11 is a support for the load handling apparatus 19. Vehicle 10 is one example of a mobile support useable with load handling apparatus 19. The support can be a fixed pedestal, a rotatable pedestal, a movable platform, the frame of a railway car, or the deck or frame structure of a ship or barge. Load handling apparatus 19 is useable as a vertical lift or a horizontal or lateral load mover.

Figure 2:
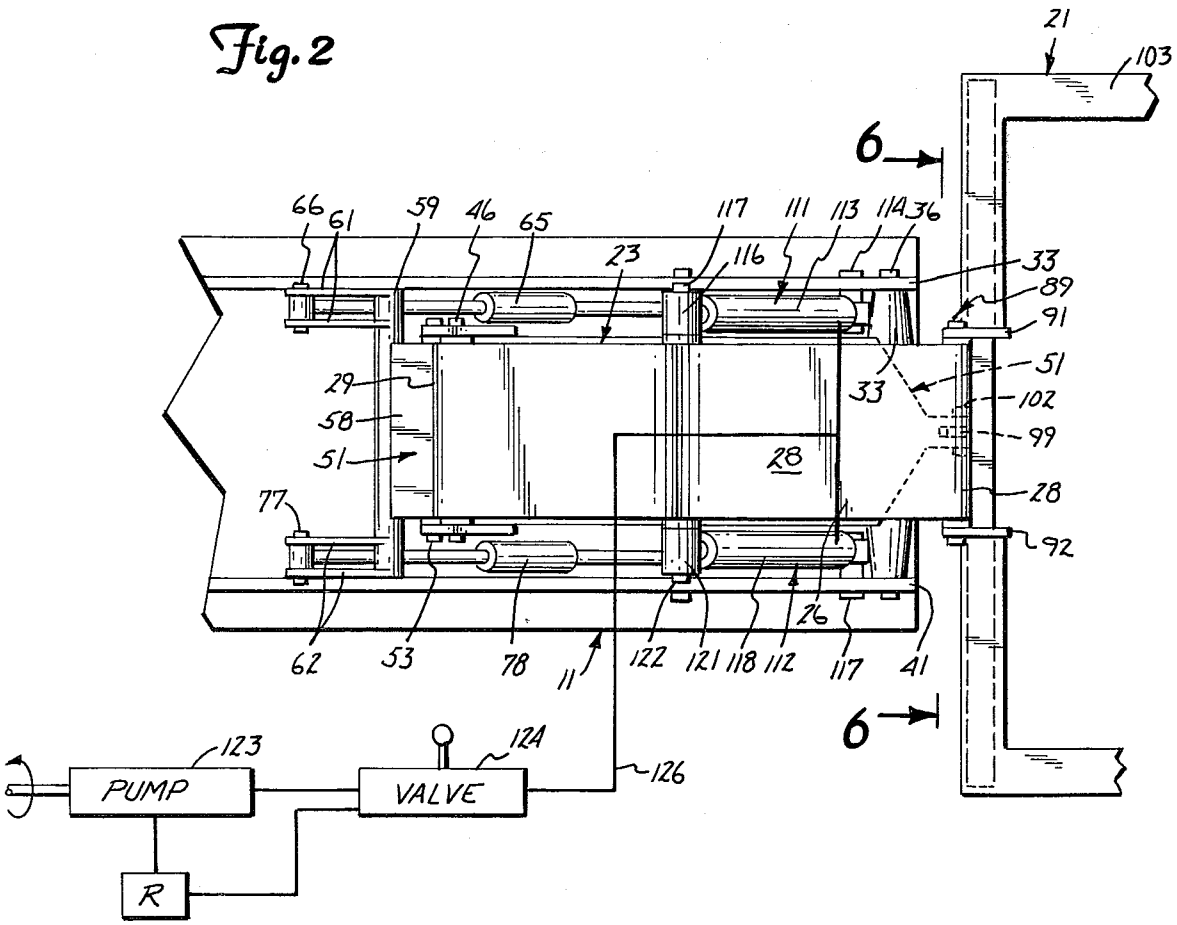
FIG. 2 is a top plan view of the load handling apparatus of FIG. 1.

Referring to FIGS. 1 and 2, load handling apparatus 19 has a longitudinally located main lift beam indicated generally at 23 located above and along the central plane of frame 11. Main lift beam 23 has a box beam construction with a generally flat bottom wall 24 and upwardly converging top wall 26. The mid-section of top wall 26 has a transverse apex 27. Lift beam 23 has a forward end 28 located above and slightly forward of the front of frame 11 and a rear end 29.

A longitudinally positioned main or first link indicated generally at 31 is located below main lift beam 23. As shown in FIG. 3, link 31 has a forward end 32 integral with a transverse member or cross head 33. Member 33 has a transverse hole accommodating a large pivot pin 36. Opposite ends of pivot pin 36 are rotatably mounted in sleeve bearings 37 and 38 mounted on longitudinal side frame members 39 and 41. Side frame members 39 and 41 are part of the vehicle frame 11 and extend in generally longitudinal direction. Side frame members 39 and 41 are laterally spaced from each other and provide the support for load handling apparatus 19.

Link 31 has a rear end 42 located below the rear end of main lift beam 23. End 42 has a pair of upright side members or plates 43 and 44 located adjacent the opposite sides of rear end 29 of lift beam 23. A transverse pivot pin 46 pivotally mounts beam 23 on side members 43 and 44. Pin 46 projects through a transverse sleeve 47 mounted in end 29 and sleeve bearings 48 and 49 mounted on side members 43 and 44.

A control beam or link indicated generally at 51 is longitudinally positioned between main lift beam 23 and first link 31. As shown in FIGS. 1 and 4, beam 51 extends through a passage or space 52 between side members 43 and 44 and below main lift beam 23. A transverse pivot pin 53 pivotally mounts a mid-section of control beam 51 to side members 43 and 44. Pin 53 projects through a sleeve 54 mounted on control beam 51. A pair of sleeve bearings 56 and 57 mounted on side members 43 and 44, respectively, rotatably accommodate opposite ends of pivot pin 53. Pivot pin 53 provides a transverse pivoting axis for control beam 51. The pivot axis for beam 51 is below and substantially parallel to the pivot axis of pin 46 for main beam 23.

Figure 5:
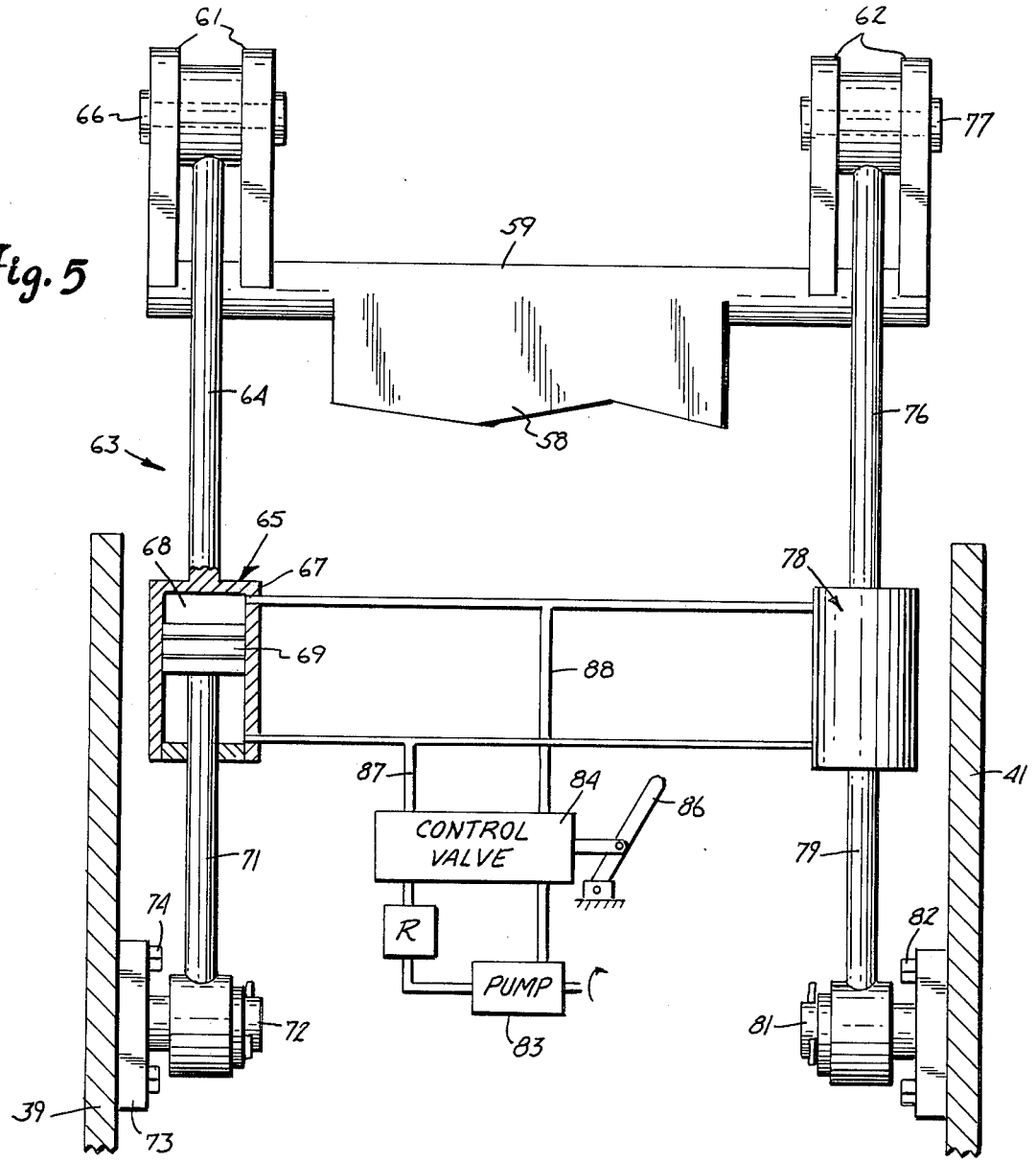
FIG. 5 is an enlarged sectional view taken along the line 5—5 of FIG. 1 and a diagrammatic view of the hydraulic control system for the second link means.

As shown in FIGS. 2 and 5, control beam 51 has an intermediate portion 58 extended upwardly from pivot pin 53. A transverse or cross member 59 is secured by welds or the like to the rear end of intermediate portion 58. A first pair of rearwardly directed arms 61 are secured to one end of cross member 59. A second pair of rearwardly directed arms 62 are secured to the opposite end of cross member 59. The arms 61 and 62 are located laterally or outwardly from opposite sides of engine 16.

A second link assembly indicated generally at 63 is pivotally connected to the outer ends of arms 61 and 62 and frame members 39 and 41. Link assembly 62 is used to control the pivotal movement of control beam 51 and the fore and aft tilting of load carrier 21.

Referring to FIG. 5, link assembly 63 has a first extendible and contractible means comprising a rod 64 pivotally connected at its upper end with a pivot pin 56 to the rear ends of arms 61. The lower end of rod 64 is attached to a piston and cylinder assembly 65 comprising a cylinder 67 having a chamber 68 accommodating a piston 69. A downwardly directed rod 71 secured to piston 69 has a lower end pivotally mounted on a lateral stub axle 72. Axle 72 projects laterally from a plate 73. Nut and bolt assemblies 74 secure plate 73 to frame side member 39. The second link assembly 63 has a second extendible and contractible means comprising an upper rod 76 attached with a transverse pivot pin 77 to the rear end of arms 62. The lower end of rod 76 is connected to a piston and cylinder assembly 78. The piston and cylinder assembly 78 is identical in structure to cylinder 67 and piston 69. A rod 79 extended downwardly from piston and cylinder assembly 78 is pivotally mounted on a lateral stub axle 81. Nut and bolt assemblies 82 attach the stub axle 81 to frame side member 41.

The piston and cylinder assemblies 65 and 78 are concurrently operated to elongate or contract second link assembly 63. A hydraulic fluid system having a pump 83 driven by engine 16 supplies hydraulic fluid under pressure to a control valve 84. The control valve 84 has a hand-operated lever 86 or similar controls located in cab 17 to permit the operator to selectively control the flow of hydraulic fluid to and from opposite ends of piston and cylinder assemblies 65 and 78 to control the expansion and contraction thereof.

Figure 6:
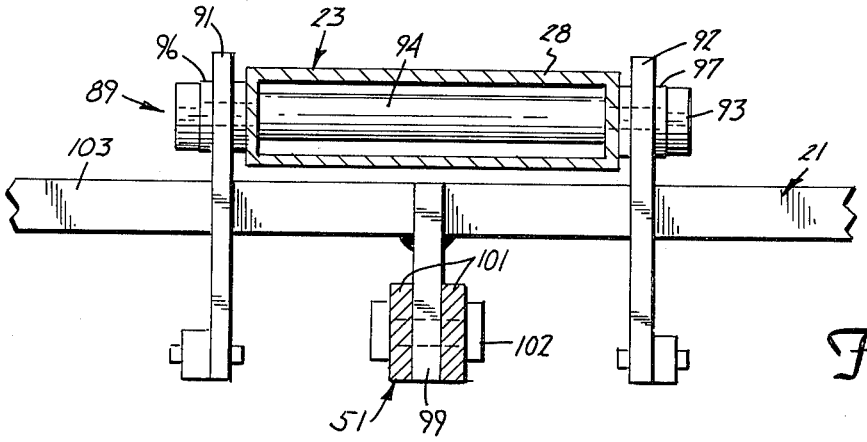
FIG. 6 is an enlarged sectional view taken along the line 6—6 of FIG. 2.

As shown in FIG. 6, third link assembly 89 comprises a pair of upright plates 91 and 92 secured to mid-section of load carrier 21. A transverse pivot pin 93 pivotally connects the forward end of main lift beam 23 to the upper end of plates 91 and 92. Pivot pin 93 projects through a transverse sleeve 94 mounted in forward end 28 of main lift beam 23. Opposite ends of pin 93 are rotatably mounted in sleeve bearings 96 and 97 mounted on the upper ends of plates 91 and 92. A downwardly directed ear or member 99 is secured to a transverse beam 103 mounted on the mid-sections of plates 91 and 92. Ear 99 is located mid-way between plates 91 and 92. The forward end 101 of control beam 51 is bifurcated and located adjacent opposite sides of ear 99. A transverse pivot pin 102 projected through aligned holes in ear 99 and forward end 101 pivotally connect control beam 51 to third link assembly 89. The transverse axis of pivot pin 102 is below and parallel to the transverse axis of pivot pin 93.

Returning to FIG. 1, load carrier 21 comprises the U-shaped frame or beam 103 that is attached to plates 91 and 92. Frame 103 is supported in a generally horizontal position with the sides of the frame extended in a forward direction. A box structure 104 is located below frame 103. A plurality of chains 106 connect or pendently support box structure 104 from frame 103. Hydraulic cylinders 107 interposed between plates 91 and 92 and box structure 104 are operably to move the box structure 104 relative to frame 103 and thereby locate a lower container clamping unit 108 in alignment with the top of cargo container 22. The lower unit 108 has a plurality of rotatable lock arms 109 adapted to lock into the corner units of container 22 to attach container 22 to lower unit 108. Hydraulic cylinders (not shown) are operable to rotate lock arms 109 to their lock and unlock positions. Load carrier 21 is a conventional cargo carrying structure used with cargo containers. It can be replaced with other structures for handling cargo trailers, bulk cargo, and like loads.

Main lift beam 26, main link 31, and control beam 51 are longitudinally located along a common vertical plane. All pivotal movements of main lift beam 26, main link 31, control beam 51, and link means 63 are about separate transverse axes that are normal to the vertical plane. As shown in FIG. 1, main beam 23, link 31, and control beam 51 are located in adjacent folded or nested positions providing apparatus 19 with a low profile or silhouette.

Figure 7:
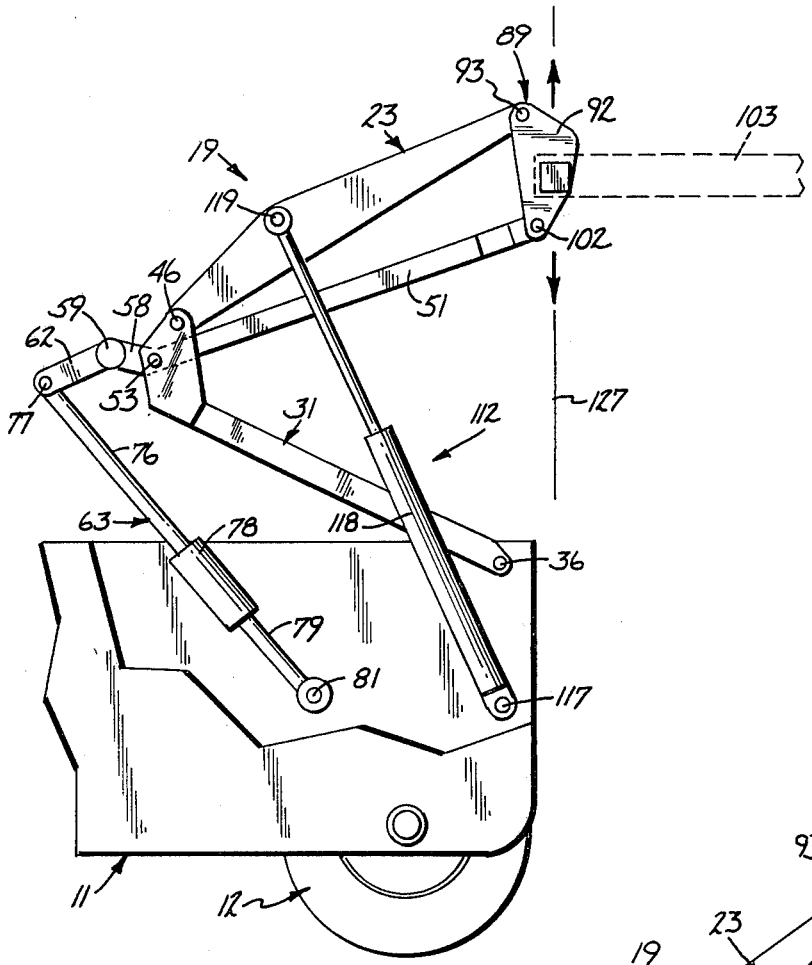
FIG. 7 is a side elevational view of the load handling apparatus in the extended position.

Load handling apparatus 19 is moved from a nested or collapsed position, as shown in FIG. 1, to an extended or raised position, shown in FIG. 7, in response to operation of an extendible and contractible means comprising extendible and contractible assemblies indicated generally at 111 and 112. Extendible and contractible assembly 111 has an elongated linear piston and cylinder assembly 113. As shown in FIG. 2, the lower end of piston and cylinder assembly 113 is pivotally connected to an inwardly directed pivot axle 114 secured to frame member 39. The upper end of the piston and cylinder assembly has a sleeve 116 rotatably mounted on a cylindrical pivot member 117. Pivot member 117 is secured to and projects outwardly from the mid-section of main lift beam 23.

Extendible and collapsible assembly 112 has a piston and cylinder assembly 118 connected at its lower end to a pivot axle 119 secured to frame member 41. The upper end of the piston and cylinder assembly 118 has a sleeve 121 pivotally mounted on a cylindrical pivot member 122. Pivot member 122 is secured to the side of main beam 23 and is in axial alignment with pivot member 117. The piston and cylinder assemblies 113 and 118 are concurrently operated to selectively raise or lower main beam 23. When main beam 23 is moved, main link 31, control beam 51, and second link 63 are articulated relative to each other and provide the support for main beam 23. The relative movements of the beams 23 and 51 and links 31 and 63 are such that the load carrier moves along a linear path, shown as vertical line 127 in FIG. 7. Hydraulic fluid under pressure is supplied from a pump 123 drivably connected to engine 16. Pump 123 delivers hydraulic fluid under pressure to a control valve 124 connected with a line 126 to the lower ends of the piston and cylinder assemblies 113 and 118. Valve 124 is located in cab 17 so that the operator of the vehicle can control the extending and collapsing of main beam 23 and thereby the lifting of cargo container 23. Other types of controls can be used to provide piston and cylinder assemblies with fluid under pressure. Piston and cylinder assemblies 113 and 118 have relatively small collapsed lengths and large strokes so as to occupy a minimum of space.

As shown in FIG. 7, the piston and cylinder assemblies 113 and 118 are in their fully extended positions. Link assembly 89 is moved in a generally vertical path along the vertical plane 127. This plane of movement is maintained during the operation of apparatus 19 from the contracted nested position shown in FIG. 1 to the full extended position, as shown in FIG. 7. Main link 51 and second link assembly 63 pivot about separate arcs and thereby cause main beam 23 and control beam 51 to pivot and move relative to each other in a manner to maintain carrier 21 in a generally horizontal position and its movement in a generally vertical plane. Apparatus 19 operates to lift the cargo container vertically. Vehicle 10 moves the raised container 21 to a stacked position. The apparatus 19 is then operated by lowering piston and cylinder assemblies 113 and 118 to vertically position the container 21 in its stored location. The operator of the vehicle does not have to compensate for the arc or swing of the container during the stacking operation.

Figure 8:
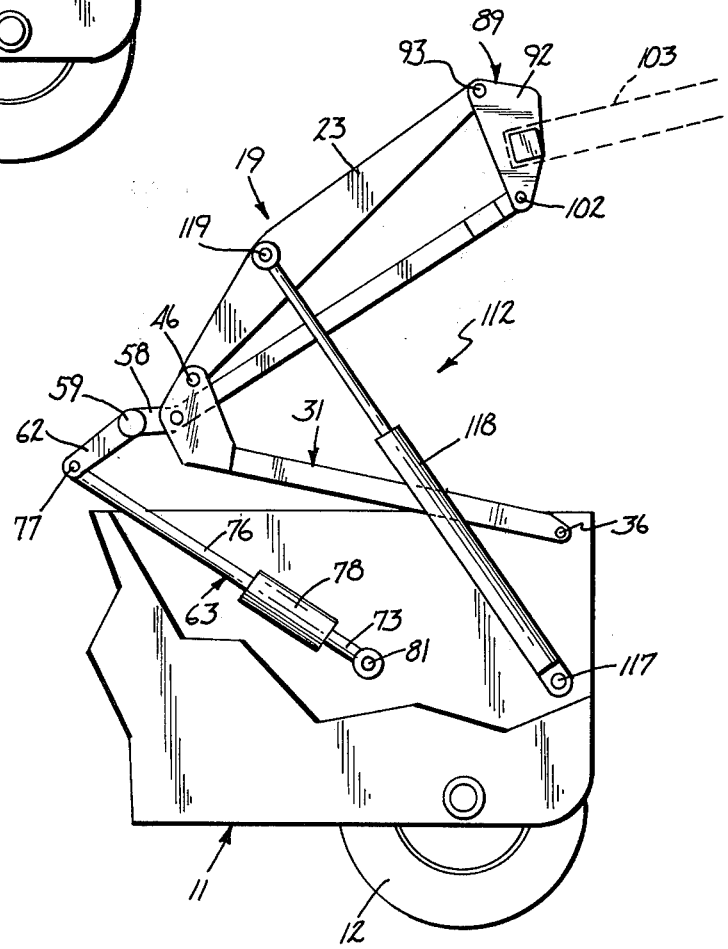
FIG. 8 is a view similar to FIG. 7 showing the load handling apparatus in the rear tilt position of the load carrier.

Referring to FIG. 8, carrier 103 can be moved rearwardly or to a rear tilt position. This is accomplished by contracting the piston and cylinder assemblies 65 and 78 and thereby reducing the overall length of the linkage assemblies 63. An increase in the length of the linkage assemblies 63 will cant or tilt frame 103 in a forward direction in front of the vertical plane 127.

As shown in FIG. 1, link 63 and expandible and contractible means 111 and 112 are pivotally connected to frame 11 adjacent opposite sides of drive wheels 12. The center of gravity of load handling apparatus 19 is behind the axis of drive wheels 12. This distributes the weight of load handling apparatus 19 between the front and rear wheels 12. The nesting arrangement of main lift beam 23, control beam 51, and links 52 and 63 and the location of the connection of load handling apparatus 19 on frame 11 permits the use of a shorter vehicle frame with less counterweight than conventional cargo container lifting and transport vehicles.

While there has been shown and described a preferred embodiment of the load handling apparatus and vehicle, it is understood that changes in the structure, arrangement of structure, and extendible and contractible assemblies can be made by those skilled in the art without departing from the invention. The invention is defined in the following claims.

The embodiments of the invention in which an exclusive property or privilege is claimed are defined as follows:

1. A load handling apparatus comprising: a support, a main lift beam located above the support and extended in a generally longitudinal direction, said lift beam having a forward end and a rear end, first link means having a lower end pivotally connected to the support and an upper end pivotally connected to the rear end of the lift beam, control beam means having a forward end and a rear end located generally parallel to said lift beam, pivot means pivotally connecting an intermediate portion of the control beam means to the first link means adjacent the upper end thereof, second link means pivotally connected to the support and rear end of the control beam means, third link means pivotally connected to the forward ends of the lift beam and control beam means, said third link means adapted to be connected to a load lifting means, and longitudinally extendible and contractible means mounted on the support and pivotally connected to an intermediate portion of the lift beam whereby extension of the extendible and contractible means moves the outer end of the lift beam to an extended position and contraction of the extendible and contractible means moves the outer end of the lift beam from the extended position to a retracted position adjacent the support.

2. The apparatus of claim 1 wherein: the upper end of said first link means has laterally spaced side members and means pivotally connecting the side members to the rear end of the beam.

3. The apparatus of claim 2 wherein: said control beam means extends between said side members of the beam.

4. The apparatus of claim 3 wherein: said control beam means is located below said beam.

5. The apparatus of claim 3 wherein: said control beam means is a linear rigid member between the first link means and third link means, and a pair of arms connected to the rigid member, said second link means being pivotally connected to said arms.

6. The apparatus of claim 5 wherein: the second link means comprises a pair of link members pivotally connected to the arms and the support.

7. The apparatus of claim 6 wherein: said link members include expandible and contractible means to vary the length of the second link means and thereby move the third link means to a tilt position.

8. The apparatus of claim 7 wherein: the expandible and contractible means comprises fluid operated piston and cylinder assemblies.

9. The apparatus of claim 3 wherein: the support includes longitudinal frame members, said frame members being laterally located relative to each other, means pivotally mounting the first link means to the frame members, means pivotally mounting the second link means to the frame members, and means pivotally mounting the extendible and contractible means to the frame members.

10. The apparatus of claim 1 wherein: the second link means has a longitudinal length that is shorter than the longitudinal length of the first link means.

11. The apparatus of claim 1 wherein: the second link means includes means to vary the length of the second link means.

12. The apparatus of claim 11 wherein: the means to vary the length of the second link means comprises fluid operated piston and cylinder means.

13. The apparatus of claim 1 wherein: the longitudinal extendible and contractible means comprises fluid operated piston and cylinder means.

14. The apparatus of claim 13 wherein: the fluid operated piston and cylinder means comprises a pair of piston and cylinder assemblies each having a first member secured to the support and a movable second member extended in a generally upright direction and pivotally connected to the intermediate portion of the beam, said piston and cylinder assembly being concurrently operable to selectively move the beam to its extended and retracted positions.

15. The apparatus of claim 1 wherein: the support includes longitudinal frame members, said frame members being laterally located relative to each other, means pivotally mounting the first link means to the frame members, means pivotally mounting the second link means to the frame members, and means pivotally mounting the extendible and contractible means to the frame members.

16. The apparatus of claim 15 including: drive wheel means operably mounted on the forward end of the frame members, steerable wheel means operably mounted on the rear end of the frame members, and power means for driving the drive wheel means.

17. A load handling and transporting vehicle comprising: a frame having a forward end and a rear end, drive wheel means operably connected to the forward end of the frame, steerable wheel means operably mounted on the rear end of the frame, lift beam means located above the frame and extended in the longitudinal direction thereof, said lift beam means having a forward end and a rear end, first link means having a lower end located adjacent said frame, first transverse pivot means pivotally connecting the lower end of the first link means to the frame, said first link means having an upper end, second transverse pivot means pivotally connecting the upper end of the first link means to the rear end of the lift beam means, control beam means having a forward end and a rear end located generally parallel to said lift beam means, third transverse pivot means pivotally connecting an intermediate portion of the control beam means to the first link means adjacent the upper end thereof, second link means pivotally connected to the frame and rear end of the control beam means, fourth transverse pivot means pivotally connecting the second link means to the control beam means, third link means located adjacent the forward ends of the lift beam means and control beam means, fifth transverse pivot means pivotally connecting the third link means to the forward ends of the lift beam means and control beam means, said third link means adapted to be connected to a load lifting structure, and longitudinally extendible and contractible means mounted on the frame, fifth transverse pivot means pivotally connecting the longitudinally extendible and contractible means to an intermediate portion of the lift beam means whereby, on extension of the extendible and contractible means, the outer end of the lift beam means moves to an extended position and, on contraction of the extendible and contractible means, the outer end of the lift beam means moves from the extended position to a retracted position adjacent said frame.

18. The apparatus of claim 17 wherein: the upper end of the first link means has laterally spaced side members, said second pivot means connecting the side members to the rear end of the lift beam means.

19. The apparatus of claim 18 wherein: said control beam means extends between said side members of the lift beam means.

20. The apparatus of claim 19 wherein: said control beam means is located below said lift beam means, said lift beam means and control beam means being located adjacent each other when the lift beam means is in its retracted position.

21. The apparatus of claim 18 wherein: said control beam means is a rigid member.

22. The apparatus of claim 17 wherein: the second link means has a longitudinal length that is shorter than the longitudinal length of the first link means.

23. The apparatus of claim 17 wherein: the control beam means has a cross member, first and second arm members secured to the cross member, said second link means comprising a pair of members pivotally connected to the frame, said fourth pivot means pivotally connecting said pair of members to said first and second arm members.

24. The apparatus of claim 23 wherein: said pair of members include expandible and contractible means to vary the length of the second link means and thereby move the third link means to a rear tilt position about a generally horizontal transverse axis.

25. The apparatus of claim 24 wherein: the expandible and contractible means comprises fluid operated piston and cylinder assemblies.

26. The apparatus of claim 17 wherein: the second link means includes means to vary the length of the second link means.

27. The apparatus of claim 26 wherein: the means to vary the length of the second link means comprises at least one fluid operated piston and cylinder assembly.

28. The apparatus of claim 17 wherein: the longitudinal extendible and contractible means comprises fluid operated piston and cylinder means.

29. The apparatus of claim 28 wherein: the fluid operated piston and cylinder means comprises a pair of piston and cylinder assemblies each having a first member secured to the frame and a movable second member extended in a generally upright direction and pivotally connected to the intermediate portion of the lift beam means, said piston and cylinder assembly being concurrently operable to selectively move the lift beam means to its extended and retracted positions.

* * * * *

UNITED STATES PATENT AND TRADEMARK OFFICE

CERTIFICATE OF CORRECTION

PATENT NO. : 4,427,334

DATED : January 24, 1984

INVENTOR(S) : Fernand Copie et al

It is certified that error appears in the above-identified patent and that said Letters Patent are hereby corrected as shown below:

Column 4, line 37, "assembly 62" should be -- assembly 63 --.

Column 5, line 30, "operably" should be -- operable --.

Signed and Sealed this

*Twenty-first* Day of *August 1984*

[SEAL]

*Attest:*

GERALD J. MOSSINGHOFF

*Attesting Officer*

*Commissioner of Patents and Trademarks*